United States Patent [19]

Bertholf

[11] 3,956,956

[45] May 18, 1976

[54] APPARATUS FOR CONTINUOUSLY FORMING OPPOSED C-SHAPED CUTS IN PLASTIC FILM

[75] Inventor: Arthur Bert Bertholf, San Leandro, Calif.

[73] Assignee: Crown Zellerbach Corporation, San Francisco, Calif.

[22] Filed: Sept. 8, 1975

[21] Appl. No.: 611,590

[52] U.S. Cl. ..... 83/345; 83/660; 83/678; 83/698

[51] Int. Cl.[2] ..... B26F 1/20

[58] Field of Search ..... 83/345, 660, 678, 698

[56] References Cited

UNITED STATES PATENTS

| | | | |
|---|---|---|---|
| 3,005,370 | 10/1961 | Nye | 83/345 |
| 3,525,280 | 8/1970 | Pavesi | 83/345 |
| 3,546,742 | 12/1970 | Kugler | 83/660 X |

*Primary Examiner*—Frank T. Yost

*Attorney, Agent, or Firm*—Corwin R. Horton; Stanley M. Teigland

[57] ABSTRACT

Opposed C-shaped cuts can be made in plastic film in a continuous manner by passing the film between a punch roll bearing specially designed punches and a mating roll having wells for receiving the punches. The special design of the punches overcomes the problem of stretching and tearing of the film normally encountered in attempting to make such cuts in plastic film using a rotary punch.

1 Claim, 7 Drawing Figures

APPARATUS FOR CONTINUOUSLY FORMING OPPOSED C-SHAPED CUTS IN PLASTIC FILM

BACKGROUND OF THE INVENTION

Plastic film used for wrapping produce such as lettuce is usually perforated to provide ventilation for the produce. One type of perforation which is especially suitable is a pattern of opposed C-shaped cuts. The opposed cuts form butterfly valves which provide the desired degree of ventilation. It would be desirable to form the cuts in the film in a continuous manner using a rotary punch, but it is difficult to form C-shaped cuts in plastic film because the film tends to stretch and tear when struck obliquely with a rotary punch, and the punch must also be withdrawn obliquely without tearing the film. Accordingly, prior to this invention, C-shaped cuts were made in plastic film in a noncontinuous operation in which an array of vertical punches was brought down onto a horizontal, stationary section of film. The maximum speed of the operation was only about 100 feet per minute. The punches were hollow cylinders having serrated cutting edges and two rectangular slits down opposite sides.

SUMMARY OF THE INVENTION

The invention is an apparatus for continuously forming a pattern of opposed C-shaped cuts in plastic film. The apparatus comprises a pair of opposed rollers. One roller has a plurality of specially designed punches extending radially therefrom. The other roller has wells for receiving the punches. Each punch is in the form of a hollow cylinder having a pair of opposed generally V-shaped grooves cut in one end and means at the other end for detachably securing the punch to the roller. The grooves meet in a pair of sharp points and the edges of the grooves are honed to form sharp cutting edges. When plastic film is passed between the rollers, the punches form a pattern of pairs of opposed C-shaped cuts in the films. The apparatus can be operated to punch film at speeds up to 1000 feet per minute.

DETAILED DESCRIPTION

Figure 1:
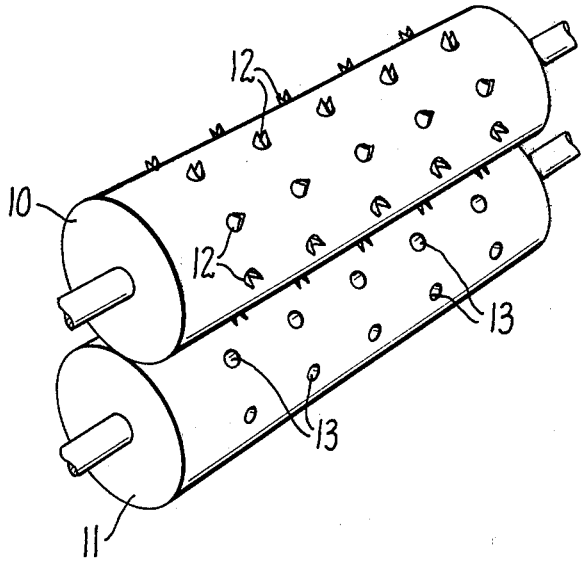
FIG. 1 is isometric view of the apparatus of the invention.
Figure 2:
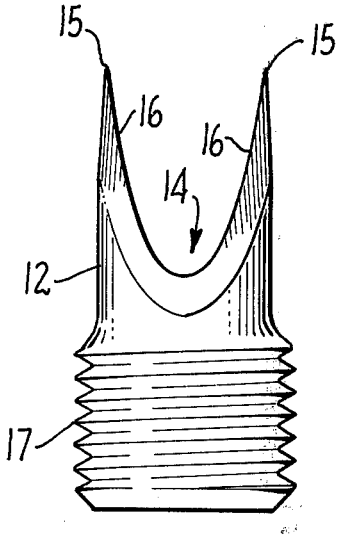
FIG. 2 is a side view of the specially designed punch employed in the apparatus.
Figure 3:
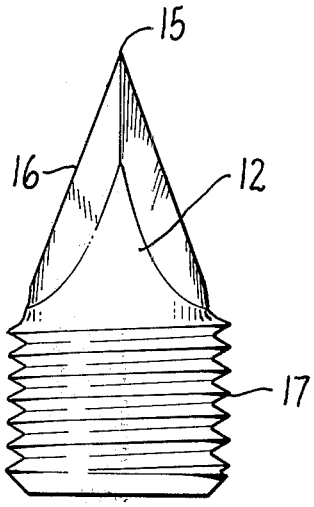
FIG. 3 is side view of the punch shown in FIG. 2 rotated 90°.
Figure 4:
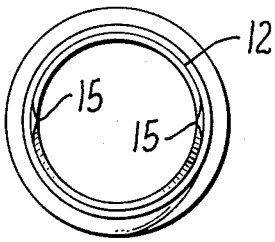
FIG. 4 is a top view of the punch shown in FIGS. 2 and 3.

Referring to FIG. 1, the apparatus comprises a pair of opposed rotatable rollers 10 and 11. Roller 10 has a plurality of punches 12 extending radially therefrom. Roller 11 has wells 13 drilled therein to receive the punches 12. The rollers 10 and 11 are rotated synchronously to assure mating of the punches 12 with the wells 13. The apparatus includes, of course, means (not shown) for supporting the rollers 10 and 11. In a commercial embodiment, the apparatus would also include means for rotating the rollers 10 and 11.

The special design of the punches 12 is shown in FIGS. 2–5. The punches are hollow cylinders. Each punch 12 has a pair of V-shaped grooves 14 cut in one end thereof. The sides of each V may be curved slightly toward each other. The grooves are cut so that they terminate and meet in two diametrically opposed points 15. The edges 16 of the grooves 14 are sharply honed.

Figure 5:
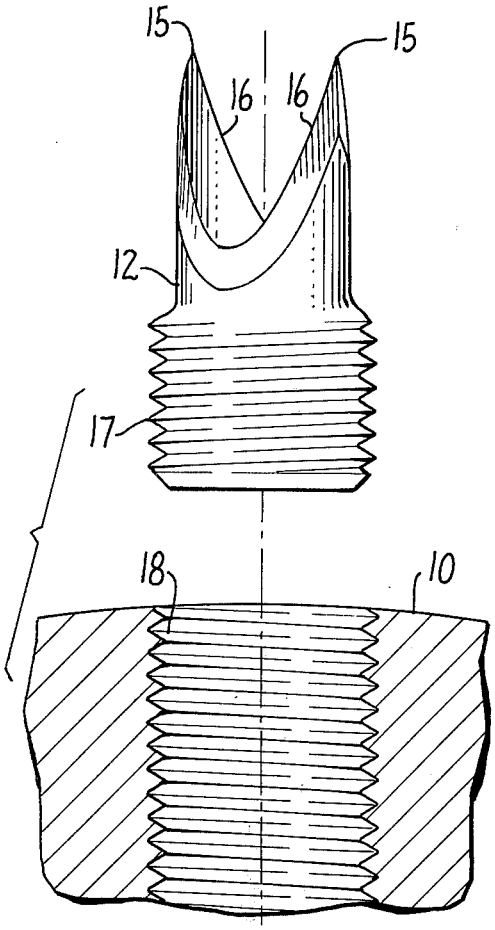
FIG. 5 depicts the punch and a cross section of a portion of the punch roller showing a threaded well therein for detachably securing the punch.

The thickness of the walls of the punch 12 is preferably from about 0.3 to 0.4 mm. The other end of the punch 12 has threads 17 for engaging threads 18 in the punch roll 10, as shown in FIG. 5. When the punch 12 is engaged in the roller 10, the two points 15 lie in a line parallel to the longitudinal axes of the rollers 10 and 11. Also, the bottom of each groove 14 is recessed below the surface of the roller 10 so the punch 12 does not cut a complete hole in the film. Since the bottom of each groove 14 is below the surface of the roller 10, it may for convenience be rounded. When the punch 12 becomes dull, it can be replaced readily. Of course, other means can be used to detachably secure the punches 12 to the punch roller 10.

Figure 7:
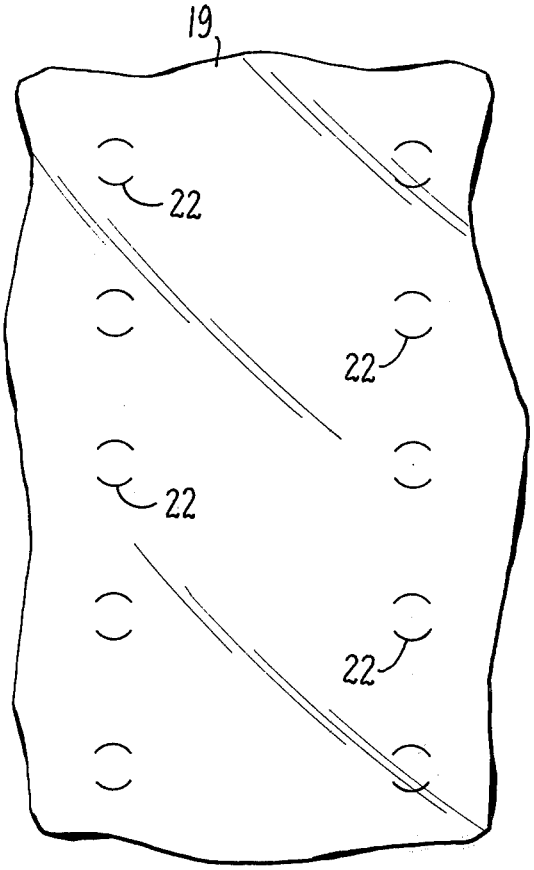
FIG. 7 shows film having a pattern of pairs of opposed C-shaped cuts formed by the apparatus.
Figure 6:
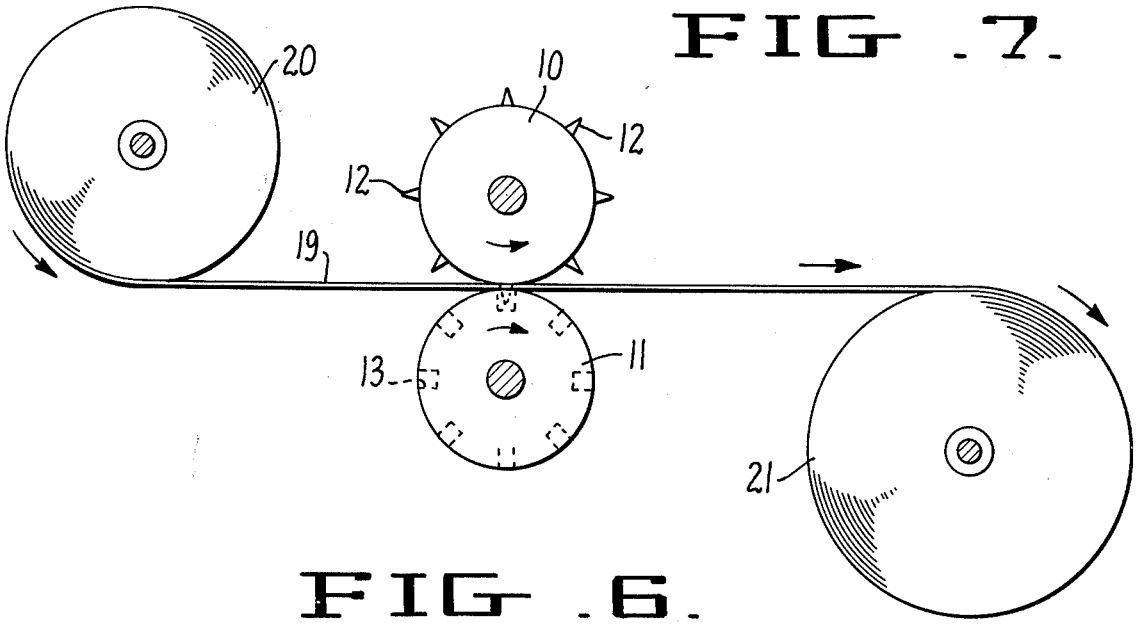
FIG. 6 illustrates operation of the appratus.

As shown in FIG. 6, plastic film 19 is passed between the rollers 10 and 11. The film is fed from a supply roll 20 and is recovered on a take-up roll 21. As the film passes between the rollers 10 and 11, the punches 12 form a pattern of pairs of opposed C-shaped cuts in the film. Any desired pattern can be formed. In a typical pattern, the pairs of cuts are 1.5 inches apart in the transverse direction and 3 inches apart in the machine direction. FIG. 7 depicts the pairs of C-shaped cuts 22 formed in a section of the plastic film 19.

I claim:

1. Apparatus for continuously forming a pattern of pairs of opposed C-shaped cuts in plastic film comprising a pair of opposed rotatable rollers, one roller having a plurality of punches extending radially therefrom, the other roller having wells therein for receiving the punches, each punch being in the form of a hollow cylinder having means at one end for detachably securing the punch to the roller and a pair of opposed generally V-shaped grooves cut in the other end such that the grooves terminate and meet in two diametrically opposed points lying in a line parallel to the longitudinal axes of the rollers, the bottom of each groove being recessed below the surface of the roller and the edges of the grooves being sharply honed, whereby when plastic film is passed between the rollers the punches form a pattern of pairs of opposed C-shaped cuts in the film.

* * * * *